US007081881B2

(12) United States Patent
Lin et al.

(10) Patent No.: US 7,081,881 B2
(45) Date of Patent: Jul. 25, 2006

(54) TIME-SHARING MULTIPLEXING DRIVING METHOD AND FRAMEWORK FOR IMAGE SIGNAL

(75) Inventors: Jan-Ruei Lin, Hsinchu (TW); Ming-Daw Chen, Hsinchu (TW); Jun-Ren Shin, Hsinchu (TW); Chang-Cheng Lin, Hsinchu (TW)

(73) Assignee: Industrial Technology Research Institute (TW)

( * ) Notice: Subject to any disclaimer, the term of this patent is extended or adjusted under 35 U.S.C. 154(b) by 385 days.

(21) Appl. No.: 10/647,326

(22) Filed: Aug. 26, 2003

(65) Prior Publication Data

US 2004/0222961 A1 Nov. 11, 2004

(30) Foreign Application Priority Data

May 8, 2003 (TW) ..... 92112543 A

(51) Int. Cl.
*G09G 3/36* (2006.01)

(52) U.S. Cl. ..... 345/103; 345/92

(58) Field of Classification Search ..... 345/58, 345/103, 92, 98

See application file for complete search history.

(56) References Cited

U.S. PATENT DOCUMENTS

| | | | | |
|---|---|---|---|---|
| 6,624,801 | B1 * | 9/2003 | Moriyama | 345/103 |
| 6,784,868 | B1 * | 8/2004 | Murahashi et al. | 345/103 |
| 6,803,896 | B1 * | 10/2004 | Senda et al. | 345/103 |
| 6,806,862 | B1 * | 10/2004 | Zhang et al. | 345/103 |
| 2003/0098833 | A1 * | 5/2003 | Sekido et al. | 345/103 |
| 2003/0122773 | A1 * | 7/2003 | Washio et al. | 345/103 |

* cited by examiner

*Primary Examiner*—Kee M. Tung
*Assistant Examiner*—Chante Harrison
(74) *Attorney, Agent, or Firm*—Bacon & Thomas PLLC

(57) ABSTRACT

The present invention relates a time-sharing multiplexing driving method and framework for image signals. By means of a plurality of wiring paths, the turned-on orders of the signal switches of the pixel units in a liquid crystal panel (LCD) are sequentially controlled so that the pixel units of two adjacent phases in the panel can have the same turned-on order. This not only can avoid the situation where the switch control signal serial connecting path in the panel is so long that the control signal of the end switch will be seriously distorted for the excessively great load, but also make the variation amounts of the adjacent pixel data voltages the same. Therefore, the objective of the invention can be achieved. Namely, no joint space is generated during the image signal time-sharing multiplexing driving.

6 Claims, 6 Drawing Sheets

TIME-SHARING MULTIPLEXING DRIVING METHOD AND FRAMEWORK FOR IMAGE SIGNAL

BACKGROUND OF THE INVENTION

1. Field of the Invention

The present invention relates to a time-sharing multiplexing driving method and framework for image signals. By means of a plurality of wiring paths, the turned-on orders of the signal switches are controlled and changed so that there is no joint space generated during the image signal time-sharing multiplexing driving.

2. Description of the Prior Art

In the conventional driving method for an active liquid crystal display (LCD), the data driver has to charge a plurality of pixel units on a horizontal scanning line to the corresponding data voltages in one horizontal scanning line time. This data driver will convert the inputted digital data into an analogy voltage level and charge it to each capacitance on the liquid crystal panel. Then, according to the different storages of electric charge voltages, the gray levels of RGB will be controlled, and a control panel will from the upward to the downward, control the gate drivers for being the switches of the pixel units, for turning on/off the transistors, such as thin film transistors. In the application of a liquid crystal display having a high resolution, a time-sharing multiplexing method is used for driving so as to decrease the required number of the data driving chips and avoid the data lines from be arranged too closely so as to avoid the generation of the signal coupling effect.

Please refer to FIG. 1. FIG. 1 is a perspective diagram of a prior art time-sharing multiplexing framework. There are m data lines (not shown) connected to a data line connector 120 for controlling a plurality of data lines on the data line connector 120 via n control signal switch wiring paths. There are i scanning lines drawn out from a gate driver 110, and the resolution of the panel 100 is m×n×i. As shown in FIG. 1, a plurality of data lines are drawn out from the liquid crystal panel 100 and connected to the data line connector 120. Therefore, a time-sharing multiplexing method is used for driving the liquid crystal panel 100, and the data lines are not arranged to be close to each other. The panel 100 is divided into two banks on the opposite sides (left and right sides), a first bank wiring paths 101 and a second bank wiring paths 102. Each of the banks has a plurality of phases and a plurality of control signal switches for controlling the data lines to be turned on/off. The first switch 101*a* of the first bank controls the first phase 11 of the first bank in the panel 100, the second switch 101*b* of the first bank controls the second phase 12 of the first bank in the panel 100, and it is analogized to the last phase, the nth phase 13 of the first bank. In addition, the first switch 102*a* of the second bank controls the first phase 14 of the second bank in the panel 100, the second switch 102*b* of the second bank controls the second phase 15 of the second bank, and it is analogized to the last phase, the nth switch 16 of the second bank.

As mentioned above, the framework can decrease the required number of the data driving chips and avoid the data lines from being arranged too closely so as to avoid the signal coupling effect, but on the glass baseboard of the liquid crystal panel, the wiring and the element will cause great load to the control so that the excessively long serial connecting switch path will cause the distortion of the transmitted signals. As shown in FIG. 2, the timing diagram of the switch control signal, when the plurality of switches of the data driver are sequentially turned on by the first switch 101*a* of the first bank, the second switch 101*b* of the first bank and so on to the nth switch 101*n* of the first bank, the excessively long serial connecting switch path will cause an unduly great load to the switch signal so as to make the signal distorted. This will affect the writing voltage value of each of the data lines. In addition, because the plurality of banks are sequentially turned on by having the phases in the same direction, the jointing phases between the two banks will appear the joint space caused by the inconsistence of the variations of the color and brightness. For example, the appearance of the joint space will be generated between the nth phase 13 of the first bank and the first phase 14 of the second bank in FIG. 1, and the joint space is caused by the difference of the voltage values of the control signal switches, the difference also resulting in the error affecting the display.

In order to improve the problems of the signal distortion and joint space in the prior art, the present invention provides a time-sharing multiplexing framework to be applied in a LCD with a high resolution.

SUMMARY OF THE INVENTION

The present invention relates a time-sharing multiplexing driving method and framework for image signals. By means of a plurality of wiring paths, the turned-on orders of the signal switches of the pixel units in a liquid crystal panel (LCD) are sequentially controlled so that the pixel units of two adjacent phases in the panel can have the same turned-on order. This not only can avoid the situation where the switch control signal serial connecting path in the panel is so long that the control signal of the end switch will be seriously distorted for the excessively great load, but also make the variation amounts of the adjacent pixel data voltages the same. Therefore, the objective of the invention can be achieved. Namely, no joint space is generated during the image signal time-sharing multiplexing driving.

BRIEF DESCRIPTION OF THE DRAWINGS

The accompanying drawings, which are incorporated in and form part of the specification in which like numerals designate like parts, illustrate preferred embodiments of the present invention and together with the description, serve to explain the principles of the invention. In the drawings.

DETAILED DESCRIPTION OF THE PREFERRED EMBODIMENT

Figure 1:
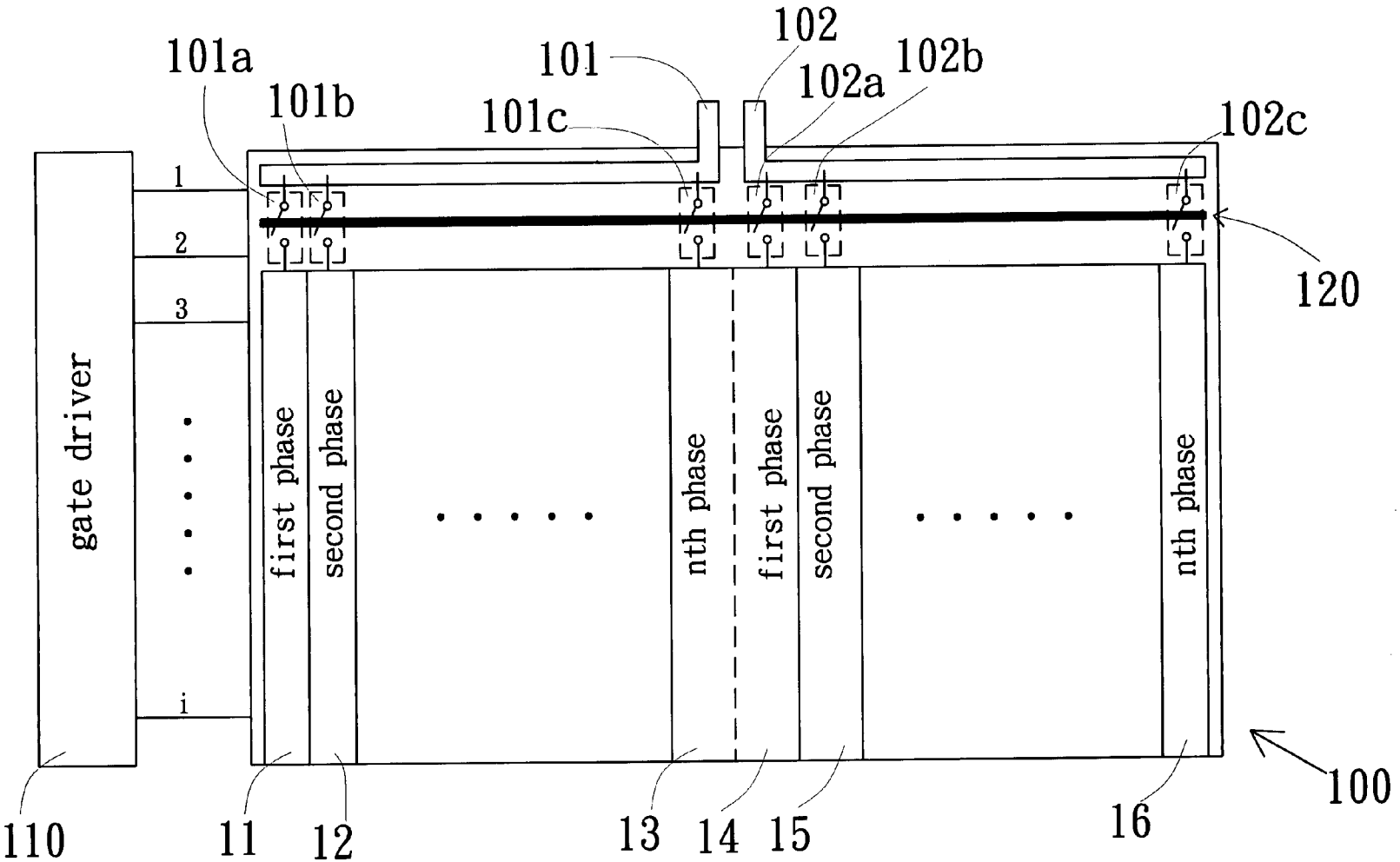
FIG. 1 (PRIOR ART)
FIG. 1 is a perspective diagram of a prior art time-sharing multiplexing framework.
Figure 2:
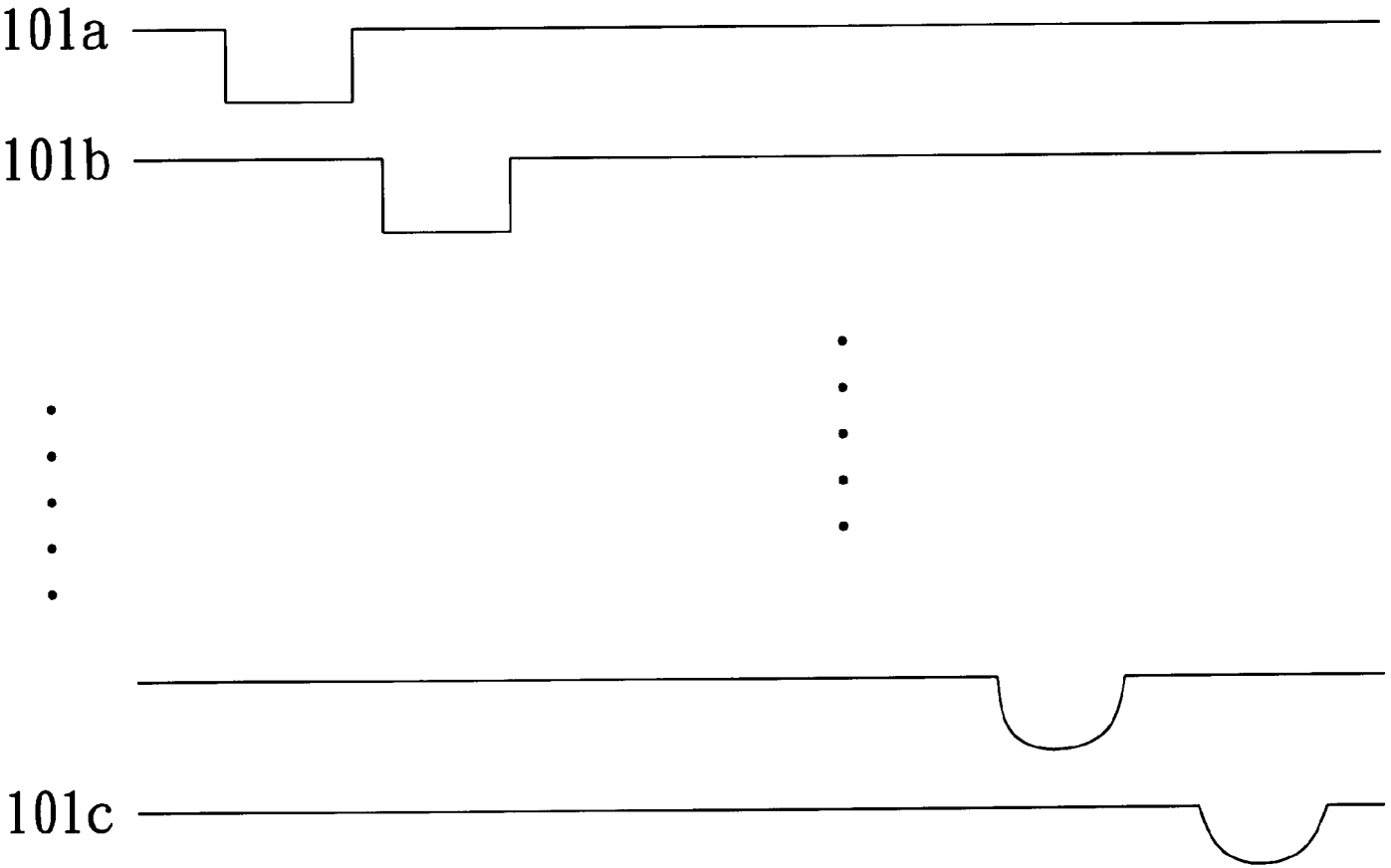
FIG. 2 (PRIOR ART)
FIG. 2 is a timing diagram of a prior art switch control signal.
Figure 3:
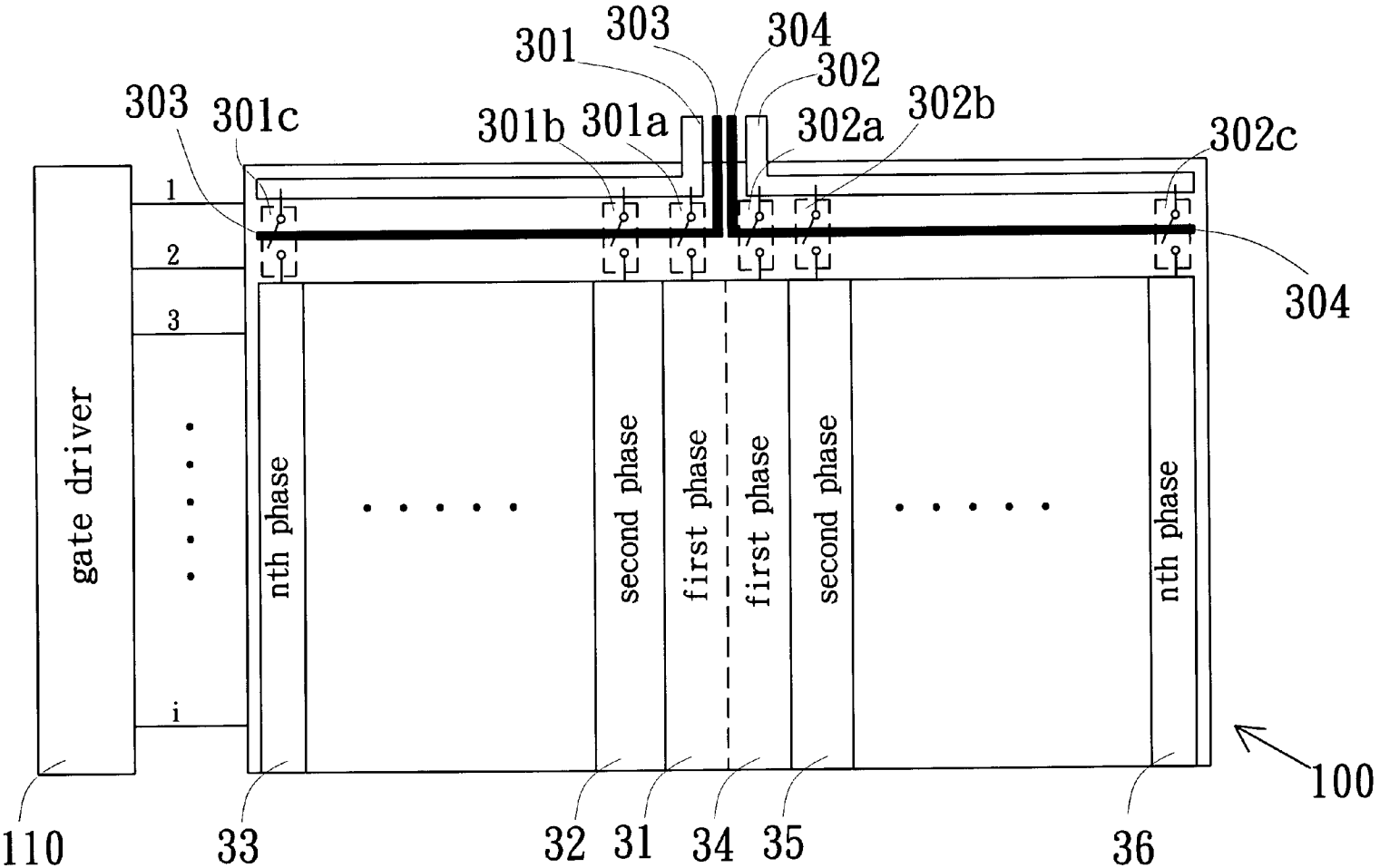
FIG. 3 is a perspective diagram of a time-sharing multiplexing framework of a first embodiment according to the present invention.
Figure 4:
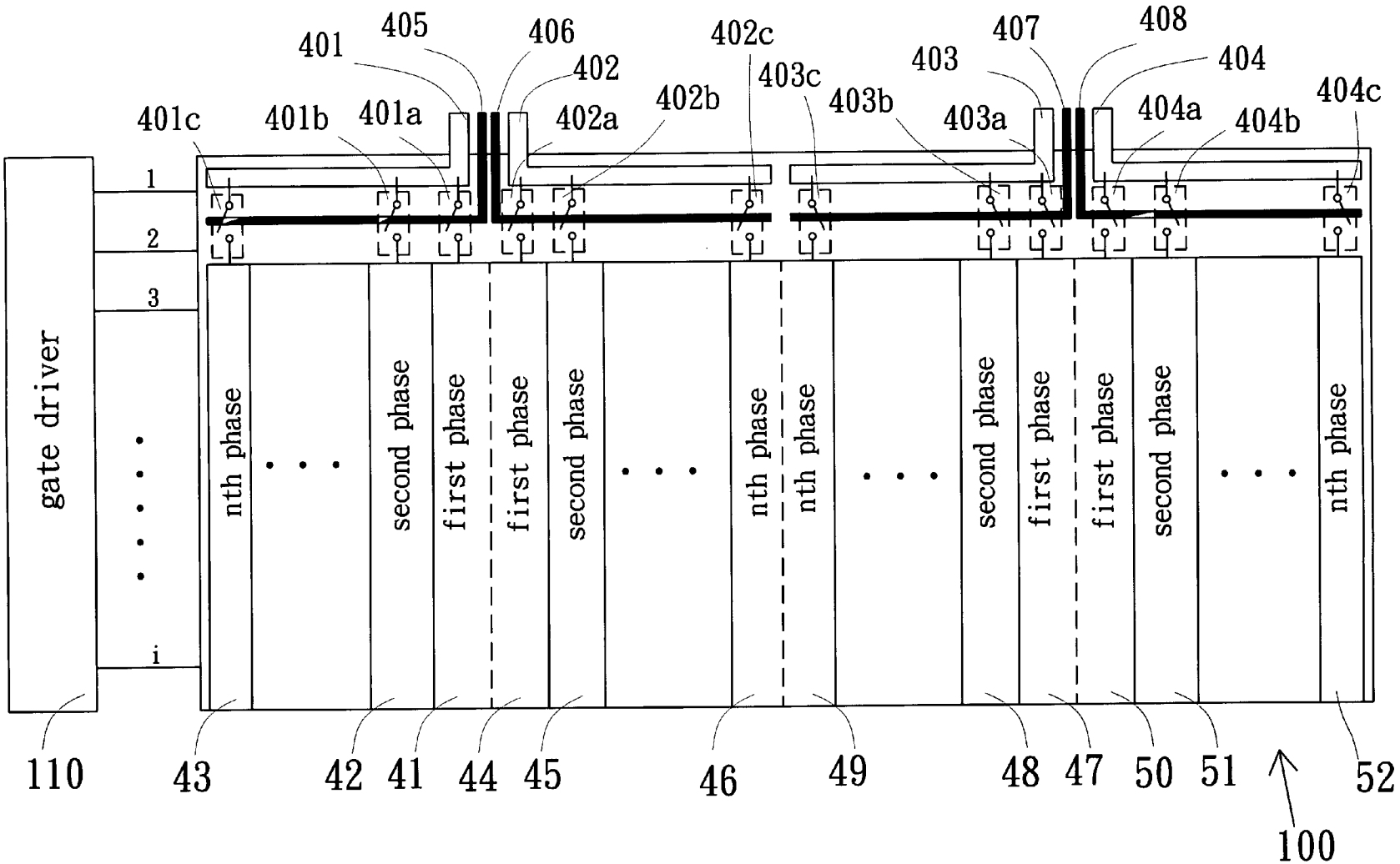
FIG. 4 is a perspective diagram of a time-sharing multiplexing framework of a second embodiment according to the present invention.

Please refer to FIG. 3. FIG. 3 is a perspective diagram of a time-sharing multiplexing framework of a first embodiment according to the present invention. The control signal switch wiring path of this embodiment is divided into two banks, a first bank wiring path 301 and a second bank wiring path 302 for separately driving the pixels on the two sides (the left and right side) of a liquid crystal panel 100. The data line connectors installed on the baseboard and connected to a plurality of data lines in a data driver is also divided into two portions, a first data line connector 303 and a second data line connector 304, and the number of the data line connectors is the same as that of the wiring paths. The two data line connectors are parallel to the signal switch wiring paths, and connected to a plurality of control switches of the first bank wiring path 301 and the second bank wiring path 302. The control switches are equally arranged on the two sides of the liquid crystal panel 100. The switch control signal has to control a plurality of control switches on the data line connector within the output pulse width time of the gate driver 110, and perform a plurality of time-sharing multiplexing operations (in this embodiment, the number of the operations is n), and charge the pixel units on a horizontal scanning line to the corresponding data voltage values. For example, the first switch 301*a* of the first bank controls a plurality of pixel units in the first phase 31 of the first bank in this panel 100, the second switch 301*b* of the first bank controls a plurality of pixel units in the second phase 32 of the first bank in this panel 100, and in the last, it is analogized that the to the third switch 303*c* of the first bank controls the nth phase 33 of the first bank. Besides, the first switch 302*a* of the second bank controls the pixel units of the first phase 34 of the second bank in this panel 100, the second switch 302*b* of the second bank controls the pixel units of the second phase 35 of the second bank, and in the last, it is analogized that the third switch 302*c* of the second bank controls the nth phase 36 of the first bank.

The framework shown in FIG. 3 can avoid the situation where the control signal serial connecting path is so long that the last control signal will be seriously distorted for the excessively great load. In addition, the first bank wiring path 301 and the second bank wiring path 302 are extended from the central line of the panel 100 to its two ends in opposite directions. In the central portion of the panel 100, the control signal wiring paths of the first bank first switch 301*a* and the second bank first switch 302*a* are the same, and are turned on at the same time, so the effect variation amounts of the pixel data voltages in the two phases are similar. Therefore, the problem of the different variations of the color and brightness in the central joint portion of the panel 100 caused by the different data line writing voltages can be resolved so as to improve the appearance of the joint space caused by the inconsistent phases in the central joint portion of the prior art panel. When the gate driver 110 starts the horizontal scanning from the upward to the downward, the first bank wiring path 301 and the second bank wiring path 302 will separately turn on the first switch 301*a* of the first bank and the first switch 302*a* of the second bank so as to make the joint part of the first phase 31 of the first bank and the first phase 34 of the second bank have the same pixel data voltage. This will make the frame harmony.

When applied in a big-size panel having a high resolution, as shown in the perspective diagram of a time-sharing multiplexing framework of a second embodiment according to the present invention, the panel 100 is divided into a plurality of banks, a first bank wiring path 401, a second bank wiring path 402, a third bank wiring path 403 and a fourth bank wiring path 404. The pixels of the liquid crystal panel 100 are also divided into four portions, and the four paths are used for separately driving the four portions of pixels. A data line connector installed on the glass baseboard and connected to a plurality of data lines of the data driver is also divided into four portions, a first data line connector 405, a second data line connector 406, a third data line connector 407 and a fourth data line connector 408, which are parallel to the above wiring paths. A plurality of control switches connected to the above wiring paths are uniformly installed on the liquid crystal panel 100, and are divided into four portions for respectively being the control signal switches of the four wiring paths. The switch control signal has to control a plurality of control switches on the data line connector within the output pulse width time of the gate driver 110 for turning on each of the scanning lines, and perform a plurality of time-sharing multiplexing operations, and charge the pixel units on the horizontal scanning line to the corresponding data voltage values. For example, the first switch 401*a* of the first bank connected to and controlled by the first bank wiring path 401 controls the first phase 41 of the first bank in this panel 100, the second switch 401*b* of the first bank controls the second phase 42 of the first bank, and so on. It is analogized that the nth switch 401*c* of the first bank controls the nth phase 43 of the first bank. The first switch 402*a* of the second bank connected to and controlled by the second bank the wiring path 402 controls the first phase 44 of the second bank, the second switch 402*b* of the second bank controls the second phase 45 of the second bank, and so on. It is analogized that the nth switch 402*c* of the second bank controls the nth phase 46 of the second bank. The first switch 401*a* of the first bank is closely adjacent to the first switch 402*a* of the second bank, and has the same control signal wiring path so as to be turned on at the same time. Therefore, the effect variation amounts of the pixel data voltages in the corresponding two phases of the first phase 41 of the first bank and the first phase 44 of the second bank are similar, and then the appearance of the joint space will not happen.

The third bank wiring path 403 and the fourth bank wiring path 404 on the other side of the panel 100 are used for controlling a plurality of signal switches, and separately have the third data line connector 407 and the fourth data line connector 408 parallel to them for conducting a plurality of data lines from the data driver onto the liquid crystal panel 100. The data lines are divided into two banks on the panel, and each of the banks has n phases as shown in the figure. The plurality of signal switches control and charge the pixel units on the horizontal scanning lines of the plurality of phases to the corresponding data voltage values so as to perform a plurality of time-sharing multiplexing operations. For example, the first switch 403*a* of the third bank connected to and controlled by the third bank wiring path 403 controls the first phase 47 of the first bank in this panel 100, the second switch 403*b* of the third bank controls the second phase 48 of the third bank, and so on. It is analogies that the nth switch 403*c* of the third bank controls the nth phase 49 of the third bank. The first switch 404*a* of the fourth bank connected to and controlled by the fourth bank wiring path 404 controls the first phase 50 of the fourth bank, the second switch 404*b* of the fourth bank controls the second phase 51 of the fourth bank, and so on. It is analogized that the nth switch 404*c* of the fourth bank controls the nth phase 52 of the fourth bank. The first switch 403*a* of the third bank is closely adjacent to the first switch 404*a* of the fourth bank, and has the same control signal wiring path so as to be turned on at the same time. Therefore, the effect variation amounts of the pixel data voltages in the two corresponding phases of the first phase 47 of the third bank and the first phase 50 of the fourth bank are similar, and then the appearance of the joint space will not happen. The nth switch 403*c* of the third bank is closely adjacent to the nth switch 402*c* of the second bank and their control signal wiring path is the nth switch so to to be turned on at the same time. Therefore, the effect variation amounts of the pixel data voltages in the two corresponding phases of the nth phase 46 of the second bank and the nth phase 49 of the third bank are similar, and then the appearance of the joint space will not happen.

Figure 5:
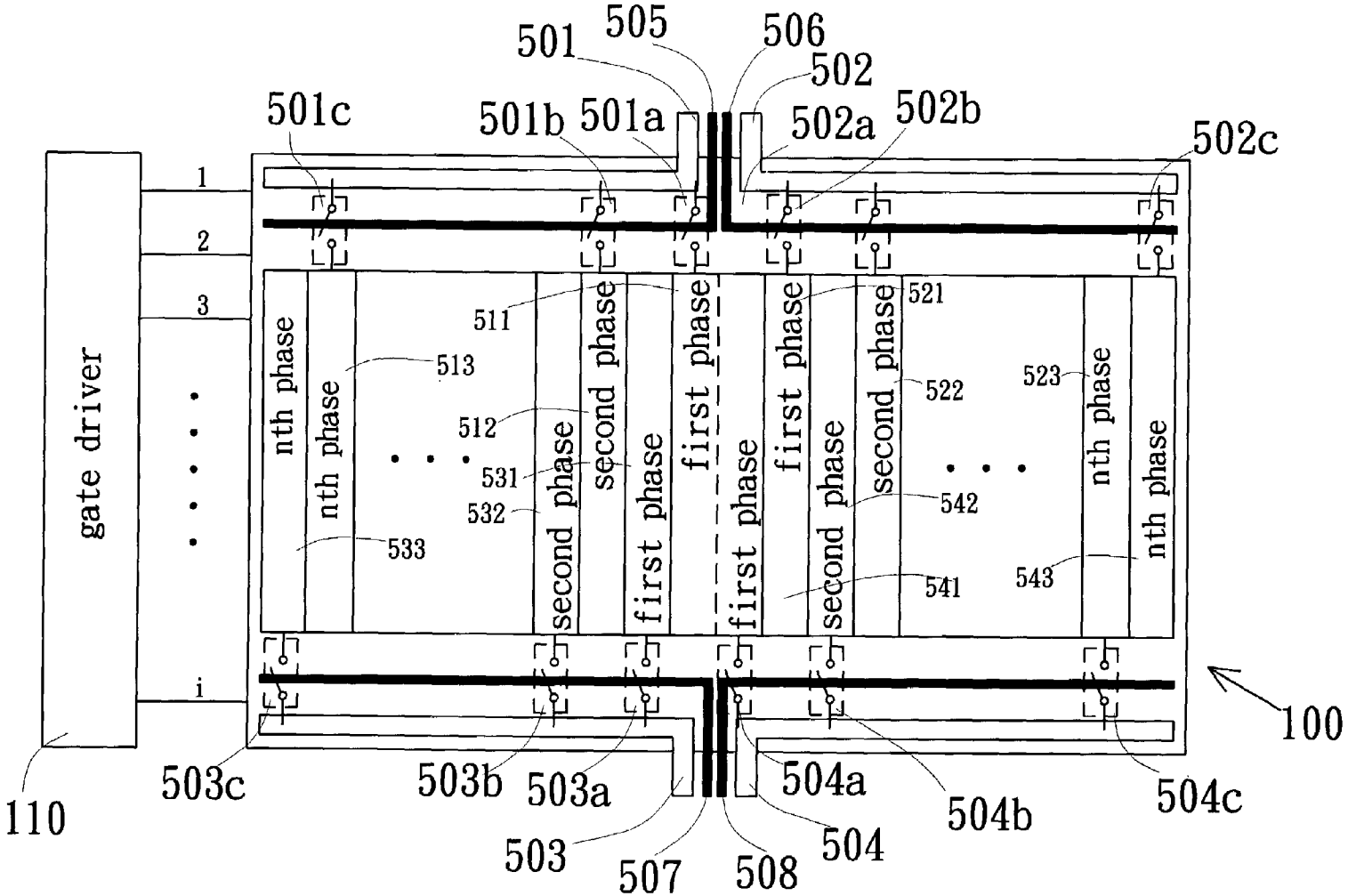
FIG. 5 is a perspective diagram of a time-sharing multiplexing framework of a third embodiment according to the present invention.

FIG. 5 is a perspective diagram of a time-sharing multiplexing framework of a third embodiment according to the present invention. In this embodiment, the data driver applies the framework where the panel 100 is driven upward/downward and odd/even. This framework especially can be applied in a display panel with a small size and a high resolution. The panel 100 is divided into four banks and two of them are on the upper side while the other two of them are on the lower side. As shown in the figure, the four are a first bank wiring path 501, a second bank wiring path 502, a third bank wiring path 503 and a fourth bank wiring path 504, and are evenly positioned on the two sides of the panel 100 so as to divide the pixels of the liquid crystal panel 100 into four portions for separately drive. In order to be applied in a small-size panel, the driving circuit is divided into two portions. A frame is divided into a plurality of phases, and the phases are separately connected to the two wiring paths on the upper side and the two wiring paths on the lower side of the panel 100 in an interlaced manner so as to control and charge the pixel units on the horizontal scanning lines to the corresponding data voltage values so as to achieve the object of multiplexing time-sharing driving. A data line connector positioned on the glass baseboard for connecting to a plurality of data lines of the data driver is divided into four portions, a first data line connector 505 and a second data line connector 506 on the upper side of the panel 100 and parallel to the above plurality of wiring paths, a third data line connector 507 and a fourth data line connector 508 on the lower side of the panel 100, and they are connected to the plurality of control switches of the above wiring paths which are uniformly positioned on the liquid crystal panel 100 and divided into four portions to separately be the control signal switches of the four wiring paths. The plurality of control switches connected to the plurality of wiring paths on the same side of the panel 100 are turned on sequentially and in opposite directions, while the plurality of control switches connected to the plurality of wiring paths on the opposite sides of the panel 100 are turned on in the same direction.

The pixel units in the panel 100 are divided into a plurality of phases, and the plurality of control switches connected to the plurality of wiring paths on the same side of this panel 100 is sequentially turned on in different directions. The plurality of phases are separately connected to and controlled by the two banks of the wiring paths on the upper side and the two banks of the wiring paths on the lower side in an interlaced manner. The first switch 501*a* of the first bank connected to and controlled by the first bank wiring path 501 controls the first phase 511 of the first bank in this panel 100, the first bank second switch 501*b* controls the second phase 512 of the first bank, and so on. It is analogized that the nth switch 501*c* of the first bank controls the nth phase 513 of the first bank. The second first switch 502*a* of the second bank connected to and controlled by the wiring path 502 controls the first phase 521 of the second bank, the second switch 502*b* of the second bank controls the second phase 522 of the second bank, and so on. It is analogized that the nth switch 502*c* of the second bank controls the nth phase 523 of the second bank. However, the first phase 511 of the first bank controlled by the above first switch 501*a* of the first bank is not closely adjacent to the first phase 521 of the second bank, and is a phase controlled by the wiring paths interlaced on the lower side of the panel 100.

The wirings on the lower side of the panel 100 are as follows. The first switch 503*a* of the third bank connected to and controlled by the third wiring path 503 controls the first phase 531 of the third bank in this panel 100, the second switch 503*b* of the third bank controls the second phase 532 of the third bank, and so on. It is analogized that the nth switch 503*c* of the third bank controls the nth phase 533 of the third bank. The first switch 504*a* of the fourth bank connected to and controlled by the wiring path 504 of the fourth bank controls the first phase 541 of the fourth bank, the second switch 504*b* of the fourth bank controls the second phase 542 of the fourth bank, and so on. It is analogized that the nth switch 504*c* of the fourth bank controls the nth phase 543 of the fourth bank. The first phase 531 of the third bank controlled by the above first switch 503*a* of the third bank is not closely adjacent to the first phase 541 of the second bank, and is phase controlled by the wiring paths interlaced on the upper side of the panel 100.

As shown in FIG. 5, in the present invention embodiment, the first phase 511 of the first bank controlled by the wiring path 501 of the first bank on the upper side of the panel 100 and the first phase 531 of the third bank controlled by the third wiring path 503 on the lower side of the panel 100 are closely adjacent to each other, and have the same control signal wiring path which is the first switch so as to be turned on at the same time. Therefore, the effect variation mounts of the pixel data voltages in the phases are similar and the appearance of the joint space will not happen. The nth phase 513 of the first bank and the nth phase 533 of the third bank are also adjacent and are turned on at the same time. Therefore, the appearance of the joint space will not happen. Similarly, the first phase 521 of the second bank and the first phase 541 of the fourth bank are adjacent phases, and are turned on at the same time. Therefore, the appearance of the joint space will not happen. The adjacent phases in the central portion of the panel 100 are the first phase 511 of the first bank and the first phase 541 of the fourth bank, and their control switch is the first switch so as to be turned on at the same time. Therefore, the appearance of the joint space will not happen.

Figure 6:
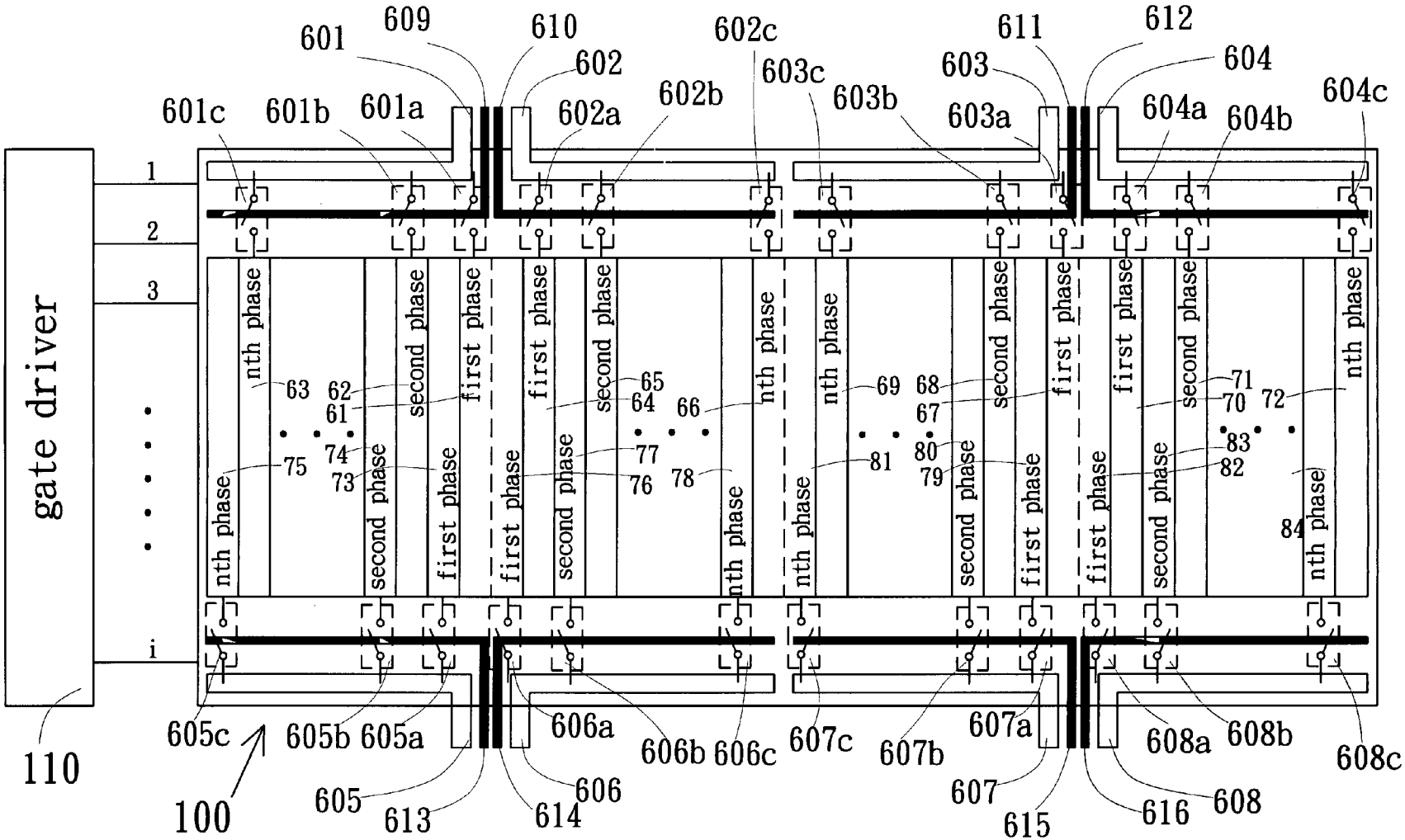
FIG. 6 is a perspective diagram of a time-sharing multiplexing framework of a fourth embodiment according to the present invention.

Please refer to FIG. 6. FIG. 6 is a perspective diagram of a time-sharing multiplexing framework of a fourth embodiment according to the present invention. The same as the data driver in FIG. 5, the data driver in FIG. 6 applies the framework where the panel 100 is driven upward/downward and odd/even, and the panel 100 is divided into eight banks, and four of them are positioned on the upper side of the panel 100 while the other four of them are positioned on the lower side. This will avoid the data lines from being arranged too closely and avoid the switch control signal serial connecting from being too long. Therefore, the data driver in FIG. 6 is advantageously used in a display panel with a small size and a high resolution. The eight banks are a first bank wiring path 601, a second bank wiring path 602, a third bank wiring path 603, a fourth bank wiring path 604, a fifth wiring path 605, sixth wiring path 606, a seventh wiring path 607 and a eighth wiring path 608, and they are evenly positioned on the two sides of the panel 100 and used for dividing the pixels of the liquid crystal panel 100 into eight portions to be driven separately. In order to be applied in a small-size panel, the driving circuit is divided into upper/lower portions, and the frame is divided into a plurality of phases. Besides, the pixel units on the horizontal scanning lines are separately connected to and controlled by the four wiring paths on the upper side and the four wiring paths on the lower side of the panel 100 in an interlaced manner so as to be charged to the corresponding data voltage values. Therefore, the object of the multiplexing time-sharing driving will be achieved.

The data line connector positioned on the glass baseboard and connected to the plurality of data lines of the data driver is also divided into eight portions. The first data line connector 609, the second data line connector 610, the third data line connector 611 and the fourth data line connector 612 are parallel to the above plurality of wiring paths and are positioned on the upper side of the panel 100 while the fifth data line connector 613, the sixth data line connector 614, the seventh data line connector 615 and the wighth data line connector 616 are positioned on the lower side of the panel 100. The plurality of control switches connected to and controlled by the above wiring paths are evenly positioned on the liquid crystal panel 100 and are also divided into eight portions, and are used to separately control the signal switches for the eight wiring paths. The plurality of control switches connected to the plurality of wiring paths on the same side of the panel 100 are sequentially turned on in opposite directions. For example, the control switches connected to and controlled by the first bank wiring path 601 and the second bank wiring path 602 are sequentially turned on in opposite directions. It is analogized that the plurality of signal control switches separately connected to and controlled by the two successive paths of the third bank wiring path 603 to the eighth wiring path 608 are sequentially turned on in opposite directions. The plurality of control switches connected to the plurality of wiring paths on the two opposite sides of the panel are turned on in the same direction and in an interlaced manner.

All of the pixel units in the panel 100 are divided into a plurality of phases. The plurality of control switches connected to the plurality of wiring paths on the same side of the panel 100 are sequentially turned on in opposite directions. The plurality of phases are separately connected to and controlled by the four banks of wiring paths on the upper side and the four banks of the wiring paths on the lower side in an interlaced manner. As shown in the figure, the first switch 601*a* of the first bank connected to and controlled by the wiring path 601 of the first bank controls the first phase 61 of the first bank in this panel 100, the second switch 601*b* of the first bank controls the second phase 62 of the first bank, and so on. It is analogized that the nth switch 601*c* of the first bank controls the nth phase 63 of the first bank. The first switch 602*a* of the second bank connected to and controlled by the wiring path 602 of the second bank controls the first phase 64 of the second bank, the second switch 602*b* of the second bank controls the second phase 65 of the second bank, and so on. It is analogized that the nth switch 602*c* of the second bank controls the nth phase 66 of the second banks. The first switch 603*a* of the third bank connected to and controlled by the third bank wiring path 603 controls the first phase 67 of the third bank in this panel 100, the second switch 603*b* of the third bank controls the second phase 68 of the third bank, and so on. It is analogized that the nth switch 603*c* of the third bank controls the nth phase 69 of the third bank. The first switch 604*a* of the fourth bank connected to and controlled by the fourth bank wiring path 604 controls the first phase 70 of the fourth bank, the second switch 604*b* of the fourth bank controls the second phase 71 of the fourth bank, and so on. It is analogized that the nth switch 604*c* of the fourth bank controls the nth phase 72 of the fourth bank. However, the first phase 61 of the first bank controlled by the first switch 601*a* of the first bank is not adjacent to the first phase 64 of the second bank, and the first phase 70 of the fourth bank controlled by the first switch 604*a* of the fourth bank is not closely adjacent to the first phase 67 of the third bank. On the contrary, they are the phases controlled by the wiring paths positioned on the lower side of panel 100 in an interlaced manner.

According to the present invention, the wiring paths on the lower side of the panel 100 in FIG. 6 are as follows. The first switch 605*a* of the fifth bank connected to and controlled by the fifth bank wiring path 605 controls the first phase 73 of the fifth bank in this panel 100, the second switch 605*b* of the fifth bank controls the second phase 74 of the fifth bank, and so on. It is analogized that the nth switch 605*c* of the fifth bank controls the nth phase 75 of the fifth bank. The first switch 606*a* of the sixth bank connected to and controlled by the sixth bank wiring path 606 controls the first phase 76 of the sixth bank, the second switch 606*b* of the sixth bank controls the second phase 77 of the sixth bank, and so on. It is analogized that the nth switch 606*c* of the sixth bank controls the nth phase 78 of the sixth bank. The first switch 607*a* of the seventh bank connected to and controlled by the seventh wiring path 607 controls the first phase 79 of the seventh bank in this panel 100, the second switch 607*b* of the seventh bank controls the second phase 80 of the seventh bank, and so on. It is analogized that the nth switch 607*c* of the seventh bank controls the nth phase 81 of the seventh bank. The first switch 608*a* of the eighth bank connected to and controlled by the eighth bank wiring path 608 controls the first phase 82 of the eighth bank, the second switch 608*b* of the eighth bank controls the second phase 83 of the eighth bank, and so on. It is analogized that the nth switch 608*c* of the eighth bank controls the nth phase 84 of the eighth bank. The first phase 73 of the fifth bank controlled by the first switch 605*a* of the eighth bank is not adjacent to the first phase 76 of the sixth bank, and the first phase 82 of the eighth bank controlled by the first switch 608*a* of the eighth bank is not adjacent to the first phase 79 of the seventh bank. They are the phases controlled by the wiring paths positioned on the upper side of the panel 100 in an interlaced manner.

As shown in FIG. 6, the first phase 61 of the first bank controlled by the first bank wiring path 601 on the upper side of the panel 100 is closely adjacent to the first phase 76 of the sixth bank controlled by the sixth bank wiring path 606 on the lower side of the panel 100, and they have the same control signal wiring path which is the first switch so as to be turned on at the same time. Therefore, the effect variation mounts of the pixel data voltages in the phases are similar, and then the appearance of the joint space will not happen. The nth phase 66 of the second bank and the nth phase 81 of the seventh bank are adjacent to each other so as to the turned on at the same time. Therefore, the appearance of the joint space will not happen. In the central portion of the panel 100, the first phase 67 of the third bank is adjacent to the first phase 82 of the eighth bank, and they are turned on at the same time and controlled by the first switch. Therefore, the appearance of the joint space will not happen.

The above is the detailed description of the time-sharing multiplexing driving method and its framework for image signals of the embodiments of the present invention. By means of a plurality of wiring paths, the turned-on orders of the signal switches are changed and controlled so that the variation amounts of the pixel data voltages of the two adjacent phases in the panel are the same, Therefore, the objective of the invention can be achieved. Namely, no joint space is generated during the image signal time-sharing multiplexing driving.

Those skilled in the art will readily observe that numerous modifications and alterations of the device may be made while retaining the teachings of the invention. Accordingly, the above disclosure should be construed as limited only by the metes and bounds of the appended

What is claimed is:

1. A time-sharing multiplexing driving framework for image signals used for changing turned-on orders of control signal switches in a liquid crystal panel so as to make the turned-on orders of two adjacent phases in the panel the same and make no joint space generated in the panel, the framework comprising:

a plurality of wiring paths being a first wiring path, a second wiring path, a third wiring path and a fourth wiring path positioned on the same side of the panel and separately driven by a plurality of banks;

a plurality of control switches connected to the plurality of wiring paths, for controlling a plurality of pixel data voltages of a plurality of phases in the panel; and a plurality of data line connectors connected to a plurality of data lines of the panel, the number of the connectors being the same as that of the wiring paths, wherein the plurality of phases connected to and controlled by the first switch of the first wiring path and the first switch of the second wiring path are adjacent to each other, and are turned on at the same time.

2. A time-sharing multiplexing driving framework for image signals used for changing turned-on orders of control signal switches in a liquid crystal panel so as to make the turned-on orders of two adjacent phases in the panel the same and make no joint space generated in the panel, the framework comprising:

a plurality of wiring paths being a first wiring path, a second wiring path, a third wiring path and a fourth wiring path positioned on the same side of the panel and separately driven by a plurality of banks;

a plurality of control switches connected to the plurality of wiring paths, for controlling a plurality of pixel data voltages of a plurality of phases in the panel; and a plurality of data line connectors connected to a plurality of data lines of the panel, the number of the connectors being the same as that of the wiring paths, wherein the plurality of phases connected to and controlled by the first switch of the third wiring path and the first switch of the fourth wiring path are adjacent to each other, and are turned on at the same time.

3. A time-sharing multiplexing driving framework for image signals used for changing turned-on orders of control signal switches in a liquid crystal panel so as to make the turned-on orders of two adjacent phases in the panel the same and make no joint space generated in the panel, the framework comprising:

a plurality of wiring paths being a first wiring path, a second wiring path, a third wiring path and a fourth wiring path evenly positioned on two sides of the panel and separately driven by a plurality of banks;

a plurality of control switches connected to the plurality of wiring paths, for controlling a plurality of pixel data voltages of a plurality of phases in the panel; and a plurality of data line connectors connected to a plurality of data lines of the panel, the number of the connectors being the same as that of the wiring paths, wherein the plurality of phases connected to and controlled by the first switch of the first wiring path and the first switch of the fourth wiring path are adjacent to each other, and are turned on at the same time.

4. A time-sharing multiplexing driving framework for image signals used for changing turned-on orders of control signal switches in a liquid crystal panel so as to make the turned-on orders of two adjacent phases in the panel the same and make no joint space generated in the panel, the framework comprising:

a plurality of wiring paths being a first wiring path, a second wiring path, a third wiring path and a fourth wiring path evenly positioned on two sides of the panel and separately driven by a plurality of banks;

a plurality of control switches connected to the plurality of wiring paths, for controlling a plurality of pixel data voltages of a plurality of phases in the panel; and a plurality of data line connectors connected to a plurality of data lines of the panel, the number of the connectors being the same as that of the wiring paths, wherein the plurality of phases connected to and controlled by the first switch of the second wiring path and the first switch of the fourth wiring path are adjacent to each other, and are turned on at the same time.

5. A time-sharing multiplexing driving framework for image signals used for changing turned-on orders of control signal switches in a liquid crystal panel so as to make the turned-on orders of two adjacent phases in the panel the same and make no joint space generated in the panel, the framework comprising:

a plurality of wiring paths being a first wiring path, a second wiring path, a third wiring path, a fourth wiring path, a first wiring path, a sixth wiring path, a seventh wiring path and an eighth wiring path, evenly positioned on two sides of the panel and separately driven by a plurality of banks;

a plurality of control switches connected to the plurality of wiring paths, for controlling a plurality of pixel data voltages of a plurality of phases of the panel; and a plurality of data line connectors connected to a plurality of data lines of the panel, the number of the connectors being the same as that of the wiring paths, wherein the plurality of phases connected to and controlled by the first switch of the first wiring path and the first switch of the sixth wiring path are adjacent to each other, and are turned on at the same time.

6. A time-sharing multiplexing driving framework for image signals used for changing turned-on orders of control signal switches in a liquid crystal panel so as to make the turned-on orders of two adjacent phases in the panel the same and make no joint space generated in the panel, the framework comprising:

a plurality of wiring paths being a first wiring path, a second wiring path, a third wiring path and a fourth wiring path evenly positioned on two sides of the panel and separately driven by a plurality of banks;

a plurality of control switches connected to the plurality of wiring paths, for controlling a plurality of pixel data voltages of a plurality of phases in the panel; and a plurality of data line connectors connected to a plurality of data lines of the panel, the number of the connectors being the same as that of the wiring paths, wherein the plurality of phases connected to and controlled by the first switch of the third wiring path and the first switch of the fourth wiring path are adjacent to each other, and are turned on at the same time.

* * * * *